US008286443B2

(12) United States Patent
Sasaki et al.

(10) Patent No.: US 8,286,443 B2
(45) Date of Patent: Oct. 16, 2012

(54) DISPENSER

(75) Inventors: Makoto Sasaki, Aichi (JP); Hiroshi Nagai, Aichi (JP); Kouichi Itou, Aichi (JP); Yuji Hirano, Aichi (JP); Motohiro Kawachi, Aichi (JP); Seiki Hosaka, Aichi (JP)

(73) Assignee: Hoshizaki Denki Kabushiki Kaisha, Aichi-ken (JP)

( * ) Notice: Subject to any disclaimer, the term of this patent is extended or adjusted under 35 U.S.C. 154(b) by 519 days.

(21) Appl. No.: 12/629,305

(22) Filed: Dec. 2, 2009

(65) Prior Publication Data

US 2010/0072225 A1 Mar. 25, 2010

(30) Foreign Application Priority Data

Dec. 5, 2008 (JP) ..... 2008-310969

(51) Int. Cl.
*F25C 1/14* (2006.01)

(52) U.S. Cl. ..... 62/354

(58) Field of Classification Search ..... 62/340, 62/354; 222/108, 146.6, 148, 149
See application file for complete search history.

(56) References Cited

U.S. PATENT DOCUMENTS

| | | | | |
|---|---|---|---|---|
| 4,848,381 | A | 7/1989 | Livingston et al. | |
| 4,860,550 | A * | 8/1989 | Aoki et al. | 62/135 |
| 5,018,363 | A * | 5/1991 | Aoki et al. | 62/135 |
| 7,896,198 | B2 * | 3/2011 | Mehus et al. | 222/77 |

FOREIGN PATENT DOCUMENTS

| | | |
|---|---|---|
| EP | 0 287 194 | 10/1988 |
| JP | 63-63887 | 4/1988 |

OTHER PUBLICATIONS

European Search Report (in English language) issued Apr. 13, 2010 in corresponding European Patent Application No. 09 01 4757.

* cited by examiner

*Primary Examiner* — Melvin Jones
(74) *Attorney, Agent, or Firm* — Wenderoth, Lind & Ponack, LLP

(57) ABSTRACT

Provided is a dispenser in which a wash water discharge opening provided to a drain pan is connected to an external tap water system via a wash water supply path. The wash water supply path is provided with a wash water supply valve for controlling whether or not to supply wash water to the drain pan. A wash control section in a controller performs timing separately from control of a generation/delivery control section for performing generation and delivery of ice chips, and also performs a wash action at predetermined time intervals by opening the wash water supply valve.

7 Claims, 14 Drawing Sheets

DISPENSER

BACKGROUND OF THE INVENTION

1. Field of the Invention

The present invention relates to a dispenser for delivering a supply containing at least one of a drink and ice chips from a delivery opening.

2. Description of the Related Art

In general, examples of the conventionally-used dispensers of such kind include a drink dispenser and an ice chip dispenser. The drink dispenser delivers such drinks as water, juice, and soup in response to an operation performed by a user. As a configuration of the drink dispenser, a configuration in which only drinks are delivered or a configuration in which ice chips are delivered together with drinks may be employed. The ice chip dispenser delivers ice chips in response to the operation performed by the user.

In some cases, such dispensers are used for drink bars in, for example, family restaurants and manga (comic book) cafes. The drink bar offers such service that allows users to freely operate a dispenser set up in a drink bar area of a restaurant or a shop in advance so that the users can freely select drinks that they want. For such a drink bar, in some cases, a drink dispenser having a configuration in which ice chips can be supplied together with drinks is set up alone. In other cases, a drink dispenser having a configuration in which only drinks are delivered is set up along with an ice chip dispenser.

When a dispenser is used for a drink bar, there occurs a case in which leftover juice or soup is thrown away into a drain pan of the dispenser. If juice and the like including juice and soup are thrown away into the drain pan, the juice and the like go dry, and may adhere to the drain pan. In order to prevent the dried juice and the like from adhering to the drain pan, wash water or the like may be supplied to the drain pan.

An example of the configuration that enables the wash water to be supplied to the drain pan includes an apparatus described in Japanese Utility Model Application Laid open No. S63-63887. Specifically, in a conventional dispenser, an ice-making water tank of a plate-type ice-making machine is connected to a drain pan by means of piping. Every time a deicing cycle of the plate-type ice-making machine is started, ice-making water stored in the ice-making water tank is supplied to the drain pan as the wash water. The deicing cycle is included in an ice-making action performed by the plate-type ice-making machine. In this cycle, the ice-making water is sprayed onto the back side of an ice-making plate, to thereby remove from the ice-making plate an ice plate formed on the front side of the ice-making plate.

With such a conventional dispenser as described above, the wash water is supplied to the drain pan every time the deicing cycle is started, which means that timing of washing the drain pan becomes irregular. Specifically, depending on the installation environment of the dispenser, the deicing cycle may not be performed all day long, and, as a result, the dried juice and the like may adhere to the drain pan.

SUMMARY OF THE INVENTION

In order to solve the above-mentioned problem, the present invention has been made, and it is therefore an object of the present invention to provide a dispenser capable of more reliably carrying out washing of a drain pan periodically to more reliably prevent dried juice and the like from adhering to the drain pan.

According to the present invention, there is provided a dispenser that delivers a supply containing at least one of a drink and ice chips from a delivery opening, and that has a drain pan disposed below the delivery opening so that the supply is received. The dispenser includes: a generation/delivery control section for controlling generation and delivery of the supply; a wash water discharge opening provided to the drain pan; a wash water supply path connected to the wash water discharge opening; a wash water supply valve provided to the wash water supply path; and a wash control section connected to the wash water supply valve, for performing, by opening the wash water supply valve, a wash action of supplying wash water to the drain pan through the wash water supply path and the wash water discharge opening. The wash control section performs timing separately from control of the generation/delivery control section, and performs the wash action at predetermined time intervals.

DETAILED DESCRIPTION OF THE PREFERRED EMBODIMENTS

Hereinbelow, embodiments for accomplishing the present invention are described with reference to the attached drawings.

First Embodiment

Figure 1:
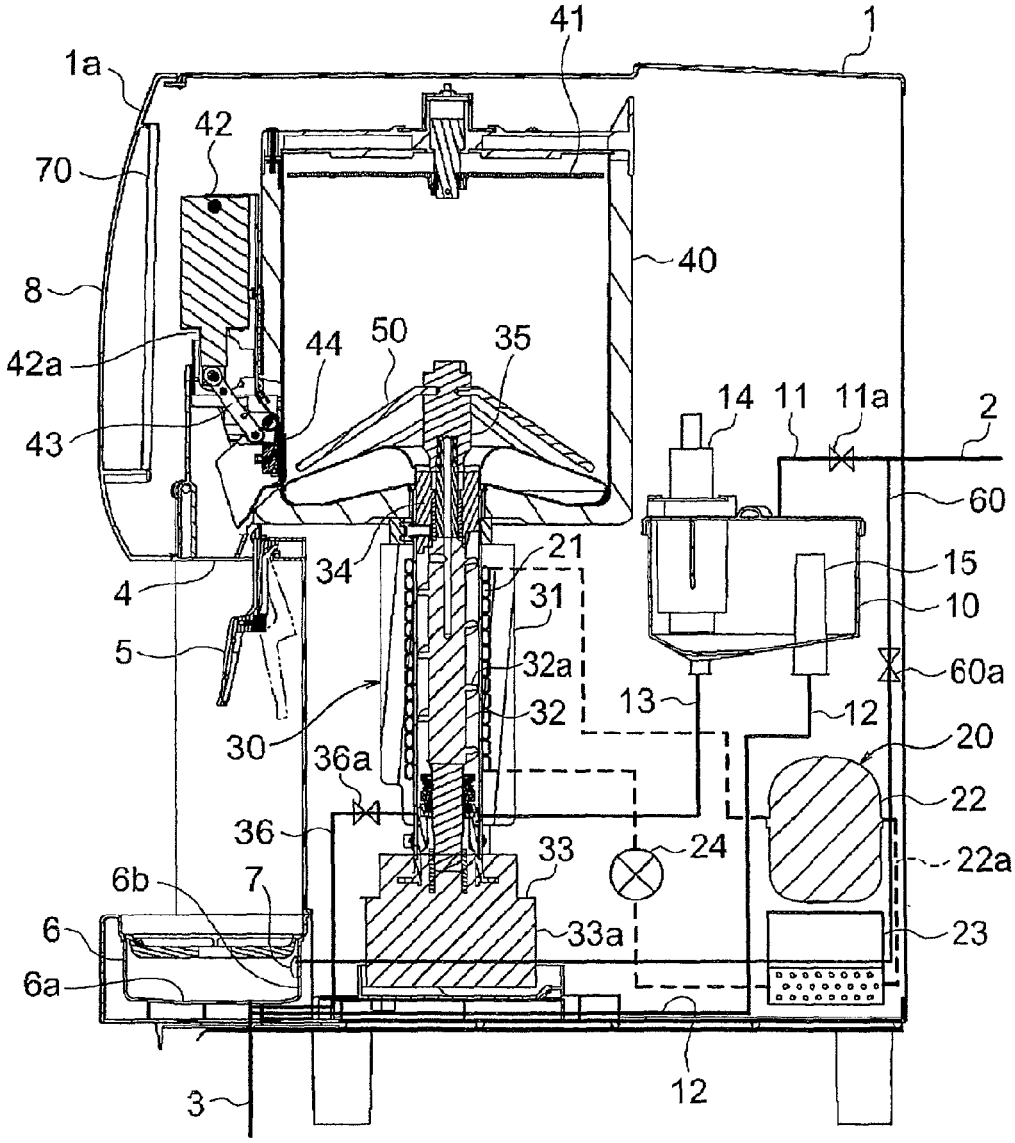
FIG. 1 is a sectional view of an ice chip dispenser according to a first embodiment of the present invention.
Figure 2:
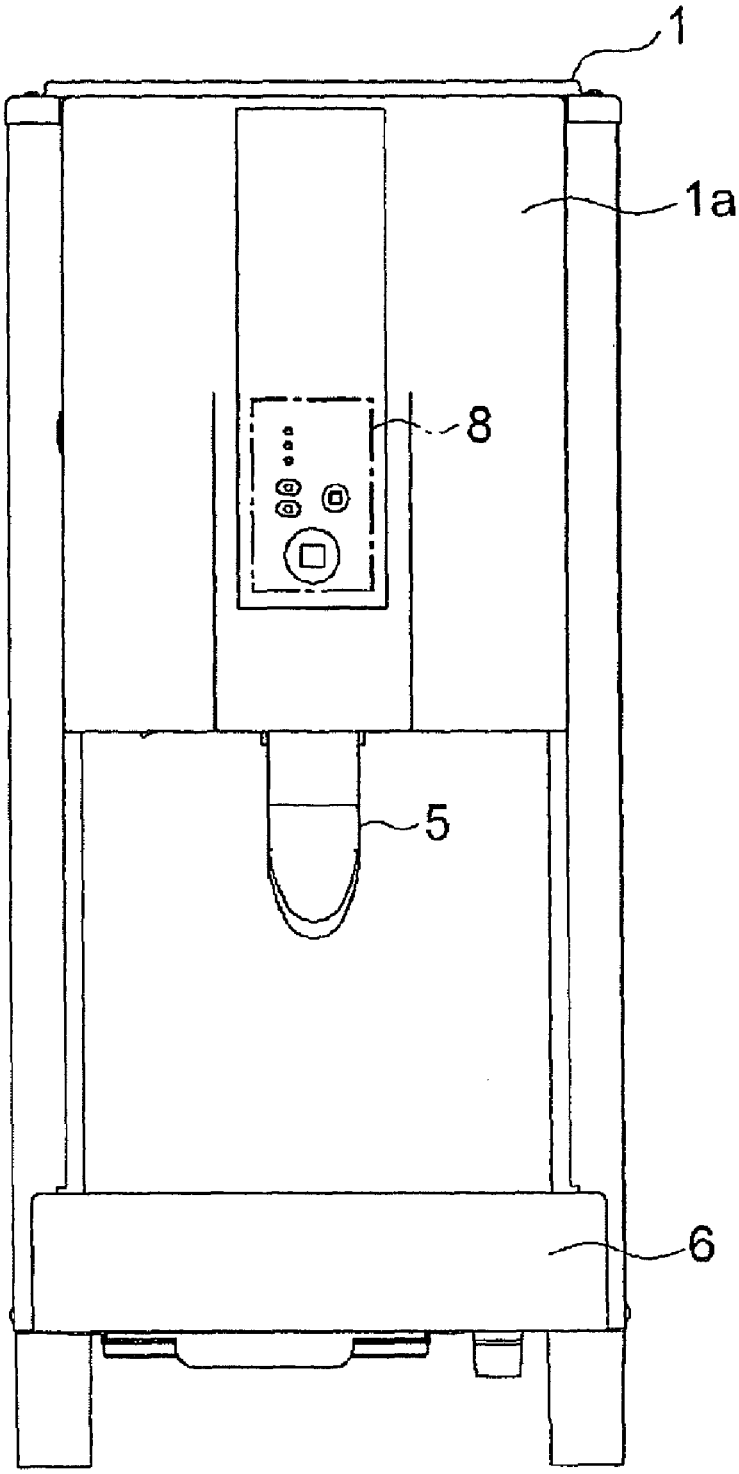
FIG. 2 is a front view of the ice chip dispenser of FIG. 1.

FIG. 1 is a sectional view of an ice chip dispenser according to a first embodiment of the present invention. FIG. 2 is a front view of the ice chip dispenser of FIG. 1. In FIG. 1, inside a casing 1, there are housed an ice-making water tank 10, a refrigeration circuit 20, an auger ice-making machine 30, an ice storage chamber 40, an agitator 50, a wash water supply path 60, and control means 70.

To the ice-making water tank 10, a water supply main tube 11, an overflow drain tube 12, and an ice-making water supply tube 13 are connected. Further, the ice-making water tank 10 is provided with a float sensor 14 and an overflow pipe 15. A top portion of the ice-making water tank 10 is connected to an external tap water system 2 via the water supply main tube 11. The water supply main tube 11 is provided with a water supply main valve 11*a* for controlling whether or not to supply ice-making water to the ice-making water tank 10. Specifically, when the water supply main valve 11*a* is opened, tap water is supplied as ice-making water from the external tap water system 2 to the ice-making water tank 10.

The float sensor 14 includes a float (not shown) that floats in the ice-making water stored in the ice-making water tank 10, and is used for detecting a water level of the ice-making water stored in the ice-making water tank 10. Specifically, the float sensor 14 detects whether or not the water level of the ice-making water has reached a predetermined upper-limit water level, and also detects whether or not the water level of the ice-making water has reached a predetermined lower-limit water level. The float sensor 14 inputs an output signal to the control means 70. The control means 70 controls the closing and opening of the water supply main valve 11*a* based on the output signal from the float sensor 14, and details thereof are described later.

The overflow pipe 15 is installed into the ice-making water tank 10 such that the upper end thereof is positioned above the upper-limit water level. Specifically, when the water level of the ice-making water is above the upper-limit water level, the overflow pipe 15 serves to exhaust the ice-making water out of the ice-making water tank 10 by the amount exceeding the upper-limit water level. The lower end of the overflow pipe 15 is connected to an external drain system 3 via the overflow drain tube 12. The ice-making water exhausted from the overflow pipe 15 flows through the overflow drain tube 12, and is then exhausted into the external drain system 3.

The ice-making water supply tube 13 connects a lower portion of the ice-making water tank 10 and the auger ice-making machine 30. The ice-making water supply tube 13 supplies the ice-making water stored in the ice-making water tank 10 to the auger ice-making machine 30.

The refrigeration circuit 20 is provided with a cooling pipe 21, a compressor 22, a condenser 23, and an expansion valve 24. The cooling pipe 21 is integrated onto the auger ice-making machine 30, and description thereof is given later. A refrigerant flows through the cooling pipe 21, and vaporization of the refrigerant causes the ice-making water of the auger ice-making machine 30 to be cooled. In other words, the cooling pipe 21 serves as an evaporator of the refrigeration circuit 20. The compressor 22 is connected to the cooling pipe 21, and compresses the refrigerant vaporized in the cooling pipe 21. The compressor 22 is connected to the condenser 23 via a high-temperature refrigerant passage 22*a*. Through the high-temperature refrigerant passage 22*a*, there passes the refrigerant with high temperature. The condenser 23 cools, through air cooling or water cooling, the refrigerant that has been compressed by the compressor 22 to thereby condense (liquefy) the refrigerant. The expansion valve 24 is connected to the condenser 23, and decompresses the refrigerant that has been condensed by the condenser 23.

The auger ice-making machine 30 is provided with a refrigeration casing 31, an auger 32, driving means 33, a stationary blade 34, and a cutter body 35.

The refrigeration casing 31 is provided generally in a cylindrical shape. The cooling pipe 21 of the refrigeration circuit 20 is embedded into the refrigeration casing 31.

The auger 32 is a longitudinal member inserted into the refrigeration casing 31, and is rotatably supported by a pair of bearings disposed at the upper and lower portions of the refrigeration casing 31. On the periphery surface of the auger 32, there is provided a helical blade 32*a* along the axial direction of the auger 32.

The driving means 33 is a geared motor connected to the auger 32, and rotationally drives the auger 32. It should be noted that, though the driving means 33 includes a gear portion 33*a* and a motor portion, only the gear portion 33*a* provided at the lower portion of the auger 32 is illustrated in a simplified manner in FIG. 1.

The stationary blade 34 is fixed at the upper portion of the refrigeration casing 31. Detailed description thereof is herein omitted, but the stationary blade 34 is provided with an insertion hole into which the upper end portion of the auger 32 is inserted and a plurality of ice compression passages extending along the axial direction of the auger 32.

The upper end portion of the auger 32 is located within the ice storage chamber 40. The upper end portion of the auger 32 is tapped, and the cutter body 35 is screwed on thereinto. The cutter body 35 is disposed so as to overlap at least part of an area of each of the ice compression passages when viewed along the axial direction of the auger 32.

To the lower portion of the refrigeration casing 31, the ice-making water supply tube 13 from the ice-making water tank 10 and an ice-making water exhaust pipe 36 are connected. The ice-making water exhaust pipe 36 connects the lower portion of the refrigeration casing 31 and the external drain system 3. The ice-making water exhaust pipe 36 is provided with an ice-making water exhaust valve 36*a* for controlling whether or not to exhaust the ice-making water. Specifically, in a state in which the ice-making water exhaust valve 36*a* is closed, the ice-making water is supplied into the refrigeration casing 31 until the water level of the refrigeration casing 31 becomes as high as the water level of the ice-making water stored in the ice-making water tank 10. On the other hand, in a state in which the ice-making water exhaust valve 36*a* is opened, the ice-making water stored in the refrigeration casing 31 is exhausted to the external drain system 3 along with the ice-making water stored in the ice-making water tank 10.

When the refrigerant is caused to pass through the cooling pipe 21 in a state in which the ice-making water is stored in the refrigeration casing 31, the ice-making water is cooled by the refrigerant. As a result, ice is formed on the inner wall of the refrigeration casing 31. The ice formed on the inner wall is scraped off by the helical blade 32*a* of the rotationally-driven auger 32, and then conveyed upward. The ice conveyed upward is compressed in the ice compression passage, and then delivered from the upper portion of the stationary blade 34 as a piece of ice in a column shape. The piece of ice in a column shape, which has been delivered from the upper portion of the stationary blade 34, is further delivered upward to come into contact with the lower portion of the cutter body 35, and then cut in a predetermined length. Pieces of the ice cut in the predetermined length are stored in the ice storage chamber 40 as ice chips.

Inside the ice storage chamber 40, there is disposed the agitator 50 including a plurality of bars secured to the upper portion of the cutter body 35. The agitator 50, which is rotationally driven along with the auger 32, agitates the ice chips stored in the ice storage chamber 40. The upper portion of the ice storage chamber 40 is provided with an ice storage sensor 41 for detecting whether or not the amount of ice chips stored in the ice storage chamber 40 has reached a full ice capacity.

On an upper sidewall of the ice storage chamber 40, there is attached a solenoid actuator 42. To a plunger 42*a* of the solenoid actuator 42, a shutter 44 in a plate shape is connected via a linkage 43. The shutter 44 closes or opens an ice discharge opening provided in a lower sidewall of the ice storage chamber 40. Specifically, in a state in which the plunger 42*a* is projected downward as in FIG. 1, the shutter 44 is pressed against the sidewall of the ice storage chamber 40 in such a manner as to cover the ice discharge opening. On the other hand, when the plunger 42*a* is displaced upward, the upward displacement of the plunger 42*a* causes the shutter 44 to be displaced upward while distancing the shutter 44 from the sidewall of the ice storage chamber 40.

At the front of the casing 1, there is provided a delivery opening 4 that communicates with the ice discharge opening of the ice storage chamber 40 and has an opening in a downward direction. Further, as illustrated in FIGS. 1 and 2, at the front of the casing 1, there is attached a lever 5 for a user to operate. The lever is incorporated with an electromagnetic switch (not shown) for detecting rotation of the lever 5. When the lever 5 is rotated by the user pressing a cup against the lever 5 for instance, the control means 70 performs drive control on the solenoid actuator 42 so that the ice discharge opening is opened. When the ice discharge opening is opened, the ice chips stored in the ice storage chamber 40 are delivered out of the casing 1 through the delivery opening 4.

As illustrated in FIGS. 1 and 2, a drain pan 6 is disposed below the delivery opening 4. Specifically, ice chips that the user fails to receive or the like can be received by the drain pan 6. The external drain system 3 is connected to a bottom 6*a* of the drain pan 6. Specifically, water generated from melting ice chips can be exhausted into the external drain system 3.

Here, in a case where the ice chip dispenser according to this embodiment is used for a drink bar in a family restaurant or the like, for example, a drink dispenser for delivering such drinks as water, juice, and soup may be provided as well near the ice chip dispenser. For example, when users want to switch their juices to other juices, the users may throw the juices including juices and soups away into the drain pan 6 of the ice chip dispenser.

In a sidewall 6*b* vertically provided at the bottom 6*a* of the drain pan 6, there is provided a wash water discharge opening 7. The external tap water system 2 is connected to the wash water discharge opening 7 via the wash water supply path 60. Specifically, the wash water supply path 60 supplies tap water from the external tap water system 2 to the drain pan 6 as wash water. Further, the wash water supply path 60 is disposed along the high-temperature refrigerant passage 22*a* provided between the compressor 22 and the condenser 23. Specifically, the wash water supply path 60 is in contact with the high-temperature refrigerant passage 22*a*, and hence the wash water within the wash water supply path 60 exchanges heat with the refrigerant of the high-temperature refrigerant passage 22*a*. Therefore, the drain pan 6 is supplied with the wash water that has exchanged heat with the refrigerant.

Further, the wash water supply path 60 is connected to the external tap water system 2 at upstream of the water supply main valve 11*a*. Specifically, the wash water supply path 60 can be supplied with the wash water regardless of the closing and opening of the water supply main valve 11*a*. Further, the wash water supply path 60 is provided with a wash water supply valve 60*a* for controlling whether or not to supply the wash water to the drain pan 6. The wash water supply valve 60*a* is located upstream of a place where the wash water supply path 60 is in contact with the high-temperature refrigerant passage 22*a*. With this configuration, deterioration of the wash water supply valve 60*a* can be reduced by avoiding a state in which the wash water supply valve 60*a* is in contact with the heat of the wash water after the heat exchange.

The control means 70 is attached to the back side of a front panel 1*a* of the casing 1. Further, as illustrated in FIG. 2, on the front side of the front panel 1*a*, there is provided an operation unit 8 including switches for the user to operate. The operation unit 8 is used for inputting a predetermined signal to the control means 70. It should be noted that, though detailed description is not given, the front panel 1*a* forms a door member as is commonly known. The control means 70 is configured by a computer including storage units (RAM and ROM) for storing information such as programs and an arithmetic processing unit (CPU) for performing arithmetic processing, or by a relay circuit. Based on input signals, the control means 70 controls actions of the ice-making water exhaust valve 36*a*, the water supply main valve 11*a*, the refrigeration circuit 20, the driving means 33, the solenoid actuator 42, and the wash water supply valve 60*a*, and description thereof is given later.

Figure 3:
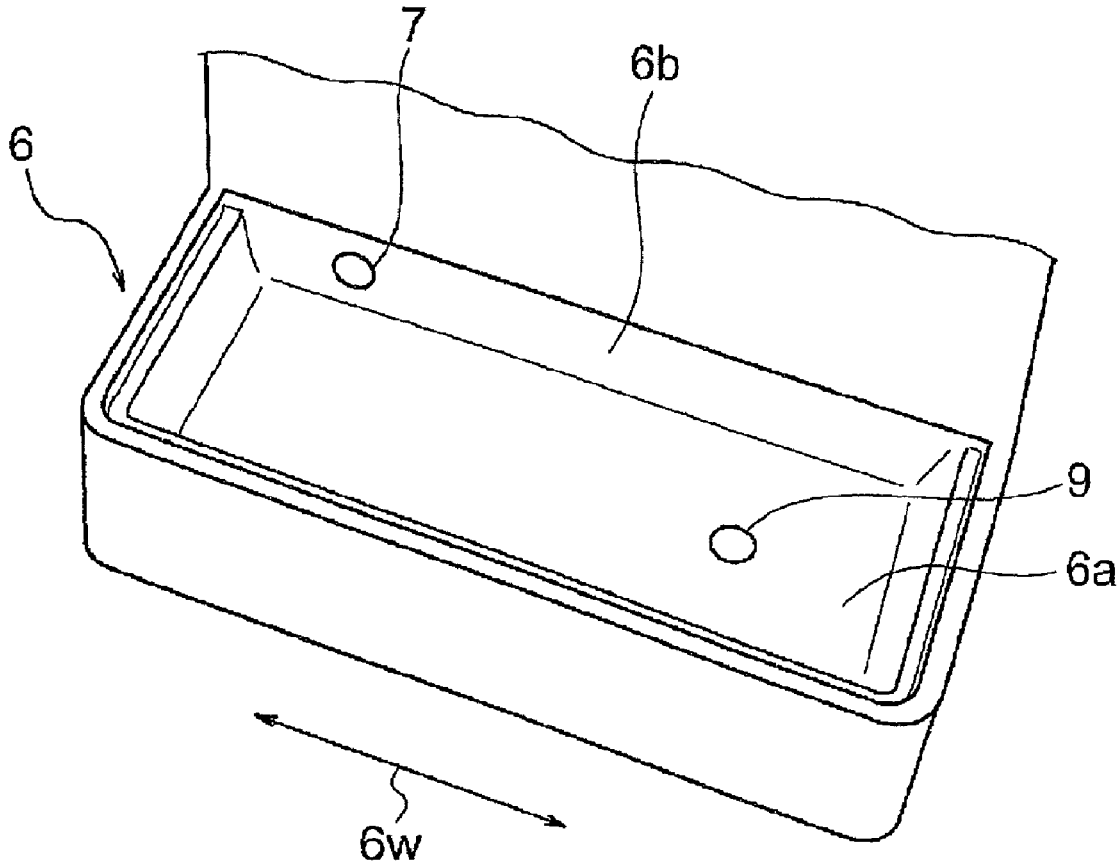
FIG. 3 is a perspective view illustrating a drain pan of FIG. 1.

Next, FIG. 3 is a perspective view illustrating the drain pan 6 of FIG. 1. FIG. 3 illustrates a state in which the drain pan 6 in front of the ice chip dispenser is viewed from above. In FIG. 3, at the bottom 6*a* of the drain pan 6, there is provided a drain hole 9 communicating with the external drain system 3. The wash water discharge opening 7 is provided in the sidewall 6*b* that is situated at the rear of the drain pan 6 and extends along a width direction 6*w* thereof. Further, the wash water discharge opening 7 is positioned at the opposite side of the drain hole 9 in the width direction 6*w* of the drain pan 6. Specifically, when the drain pan 6 is viewed from the front of the dispenser as in FIG. 3, if the drain hole 9 is disposed on the right-hand side, the wash water discharge opening 7 is disposed on the left-hand side. With this configuration, the wash water does not flow directly into the drain hole 9, but flows into the drain hole 9 after washing a wider area of the bottom 6*a*.

Figure 4:
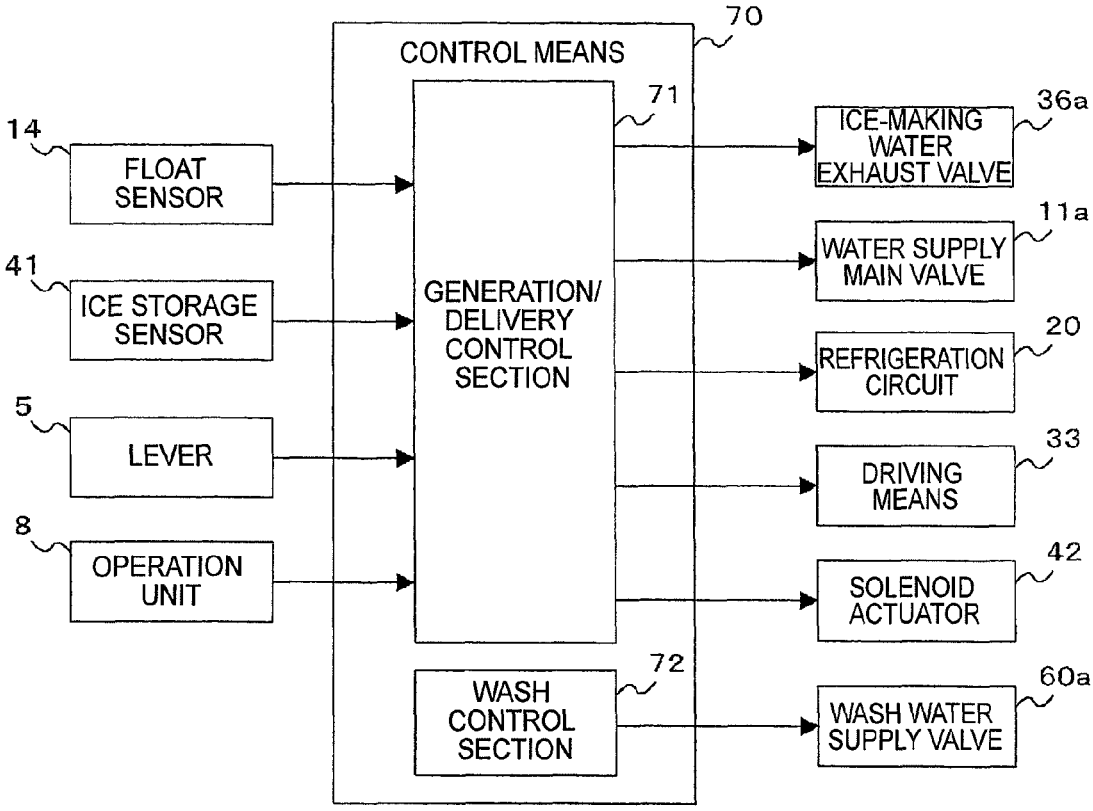
FIG. 4 is a block diagram illustrating control means of FIG. 1.

Next, FIG. 4 is a block diagram illustrating the control means 70 of FIG. 1. In FIG. 4, the control means 70 includes a generation/delivery control section 71 for controlling the generation and supply of ice chips serving as a supply and a wash control section 72 for performing a wash action.

When it is detected, by the float sensor 14, that the water level of the ice-making water stored in the ice-making water tank 10 has not reached the lower-limit water level, the generation/delivery control section 71 closes the ice-making water exhaust valve 36*a*, and also opens the water supply main valve 11*a*, to thereby supply the ice-making water to the ice-making water tank 10 and the refrigeration casing 31. On the other hand, when it is detected, by the float sensor 14, that the water level of the ice-making water stored in the ice-making water tank 10 has reached the upper-limit water level, the generation/delivery control section 71 closes the water supply main valve 11*a*, to thereby stop supplying the ice-making water to the ice-making water tank 10 and the refrigeration casing 31.

Further, when it is detected, by the ice storage sensor 41, that the amount of ice chips stored in the ice storage chamber 40 has not reached the full ice capacity, the generation/delivery control section 71 activates the refrigeration circuit 20, and also activates the driving means 33 of the auger ice-making machine 30, to thereby cause the refrigeration circuit 20 and the auger ice-making machine 30 to carry out the action of generating ice chips. Further, when it is detected, by the ice storage sensor 41, that the amount of ice chips stored in the ice storage chamber 40 has reached the full ice capacity, the generation/delivery control section 71 stops driving the refrigeration circuit 20 and the driving means 33, to thereby stop the action of generating ice chips. Further, after the generation/delivery control section 71 stops the action of generating ice chips, the generation/delivery control section 71 starts to time, and drives the driving means 33 at predetermined time intervals, which causes the agitator 50 to carry out an agitation action for the ice chips.

Further, when it is detected, by the electromagnetic switch of the lever 5, that the lever 5 is rotated, the generation/delivery control section 71 displaces the shutter 44 by displacing upward the plunger 42*a* of the solenoid actuator 42, which causes the ice discharge opening of the ice storage chamber 40 to open. Further, the generation/delivery control section 71 keeps, for a predetermined time duration, a state in which the plunger 42*a* is displaced upward, and then displaces the plunger 42*a* downward to cause the shutter 44 to close the ice discharge opening of the ice storage chamber 40.

Further, when a predetermined time duration has elapsed after start of supplying the ice-making water to the ice-making water tank 10 and the refrigeration casing 31 and when the operation unit 8 is operated, the generation/delivery control section 71 closes the water supply main valve 11*a*, and, at the same time, opens the ice-making water exhaust valve 36*a* to exhaust the ice-making water stored in the ice-making water tank 10 and the refrigeration casing 31 into the external drain system 3. This action is performed to prevent the impurity concentration of the ice-making water stored in the ice-making water tank 10 and the refrigeration casing 31 from becoming too high.

The wash control section 72 is connected to the wash water supply valve 60*a*. By opening the wash water supply valve 60*a*, the wash control section 72 performs the wash action of supplying the wash water to the drain pan 6 through the wash water supply path 60 and the wash water discharge opening 7. The wash control section 72 performs timing separately from the control of the generation/delivery control section 71, and also performs the wash action at predetermined time intervals. Detailed description thereof is given later. Here, the timing is performed by counting clock signals output at fixed intervals from, for example, a timer.

Figure 5:
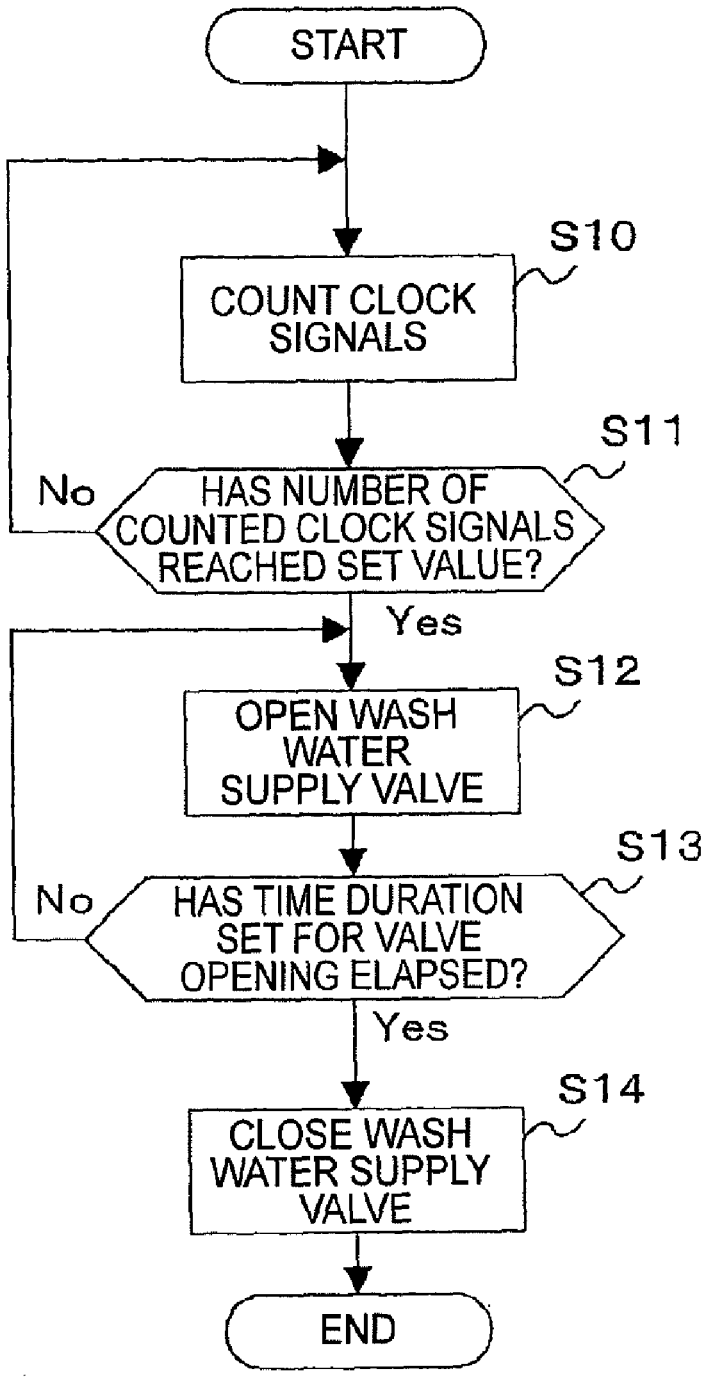
FIG. 5 is a flow chart illustrating an action of judging whether or not to carry out a wash action, which is performed by a wash control section of FIG. 4.

Next, FIG. 5 is a flow chart illustrating an action of judging whether or not to carry out the wash action, which is performed by the wash control section 72 of FIG. 4. In FIG. 5, after the entire ice chip dispenser is powered on, the counting of the clock signals is started in response to the power-on (Step S10), and also, it is judged whether or not the number of counted clock signals has reached a set value (Step S11).

On this occasion, when it is judged that the number of counted clock signals has not reached the set value, the counting of the clock signals is continued. On the other hand, when it is judged that the number of counted clock signals has reached the set value, the wash action is carried out (Steps S12 to S14). Specifically, the wash water supply valve 60*a* is opened to supply the wash water to the drain pan 6 (Step S12), and then it is judged whether or not a predetermined time duration set for valve opening has elapsed (Step S13). When it is judged that the time duration set for valve opening has elapsed, the wash water supply valve 60*a* is closed (Step S14).

The action of judging whether or not to carry out the wash action is repeatedly performed while the entire ice chip dispenser is in a powered-on state. Specifically, regardless of whether or not the actions of generating and supplying ice chips are performed, the clock signals are counted, and the wash action is performed at predetermined time intervals at which the number of counted clock signals reaches the set value.

In such a dispenser, the wash control section 72 performs the timing separately from the control of the generation/delivery control section 71, and also performs the wash action at the predetermined time intervals. As a result, the drain pan 6 can be washed periodically regardless of the control of the generation/delivery control section 71, which makes it possible to reliably prevent dried juice and the like from adhering to the drain pan 6. Specifically, even in such an installation environment that the generation of ice chips is not performed all day long, for example, it is possible to prevent juice and the like from adhering to the drain pan 6 regardless of the installation environment.

Second Embodiment

Figure 6:
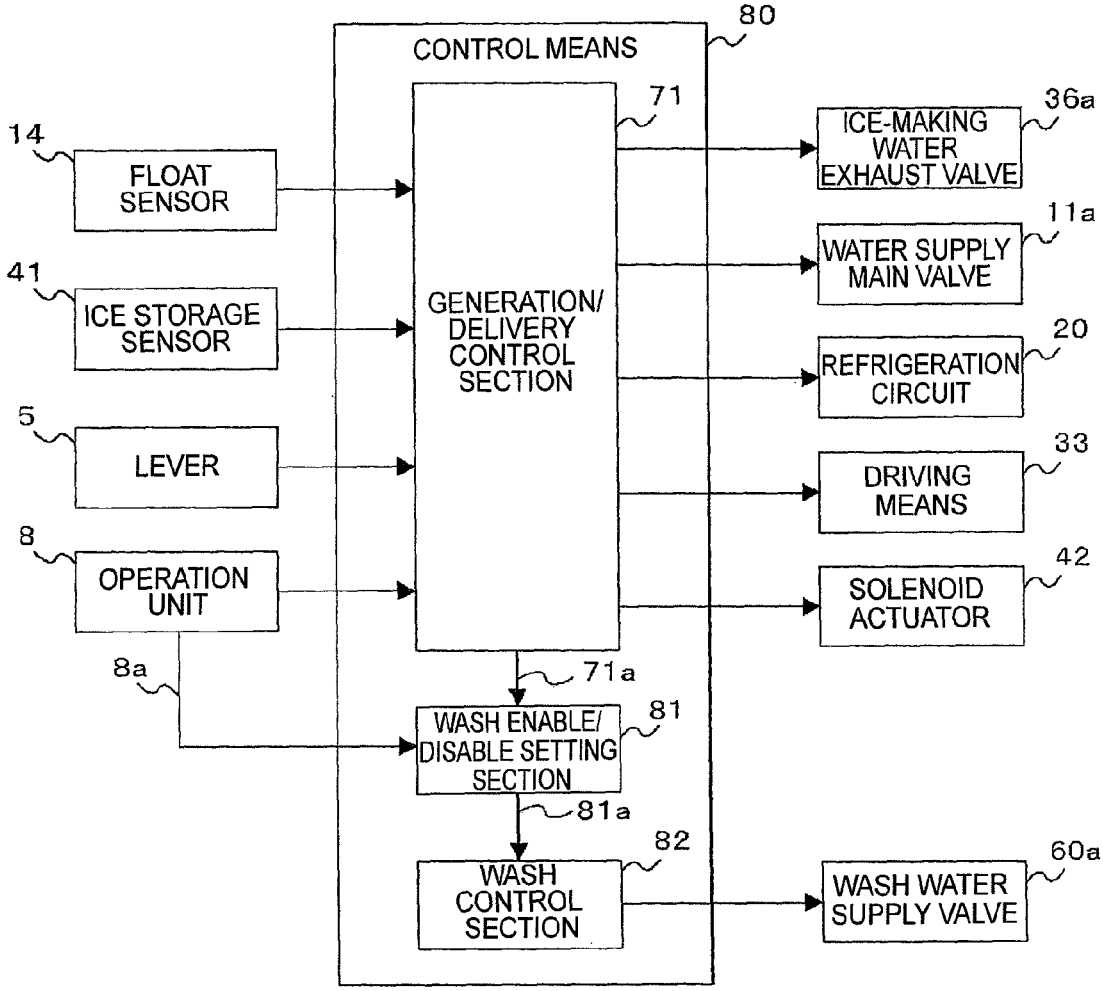
FIG. 6 is a block diagram illustrating control means of an ice chip dispenser according to a second embodiment of the present invention.

FIG. 6 is a block diagram illustrating control means 80 of an ice chip dispenser according to a second embodiment of the present invention. It should be noted that the same components as those of the first embodiment are denoted by the same reference numerals and symbols. In FIG. 6, compared to the control means 70 of the first embodiment, the control means 80 of the second embodiment is additionally provided with a wash enable/disable setting section 81. The wash enable/disable setting section 81 is connected to a wash control section 82, and inputs a wash enabling/disabling signal 81*a* to the wash control section 82. The wash control section 82 of the second embodiment determines whether or not to perform the wash action based on the wash enabling/disabling signal 81*a*.

To the wash enable/disable setting section 81, an enable/disable operation signal 8*a* is input from the operation unit 8. The wash enable/disable setting section 81 determines, based on the enable/disable operation signal 8*a*, whether to output a wash enabling/disabling signal 81*a* for inhibiting the wash action from being carried out or to output a wash enabling/disabling signal 81*a* for permitting the wash action to be carried out. Specifically, the ice chip dispenser of the second embodiment is so configured that the user can change the inhibition and permission of the wash action arbitrarily. This configuration is made to prevent the wash action from being unnecessarily carried out in an installation environment in which juice and the like are not served, that is, an installation environment in which only cold water or tea is served.

Further, to the wash enable/disable setting section 81, operational information 71*a* is input from the generation/delivery control section 71. The operational information 71*a*, which is information indicating a frequency of delivering the ice chips, indicates the number of times the ice chips are delivered within a predetermined time duration. Here, a time period during which the frequency of delivering the ice chips is lower than a predetermined frequency is referred to as an off-peak time period. The wash enable/disable setting section 81 judges whether or not a current time falls within the off-peak time period based on the operational information 71*a*. When it is judged that the current time does not fall within the off-peak time period, the wash enable/disable setting section 81 inputs, to the wash control section 82, the wash enabling/disabling signal 81*a* for inhibiting the wash action from being carried out. This configuration is made to prevent the wash action from affecting the ice-making action, and allows the wash action to be carried out only in the off-peak time period during which the ice-making action is carried out less frequently. The rest of the configuration is the same as that of the first embodiment.

Figure 7:
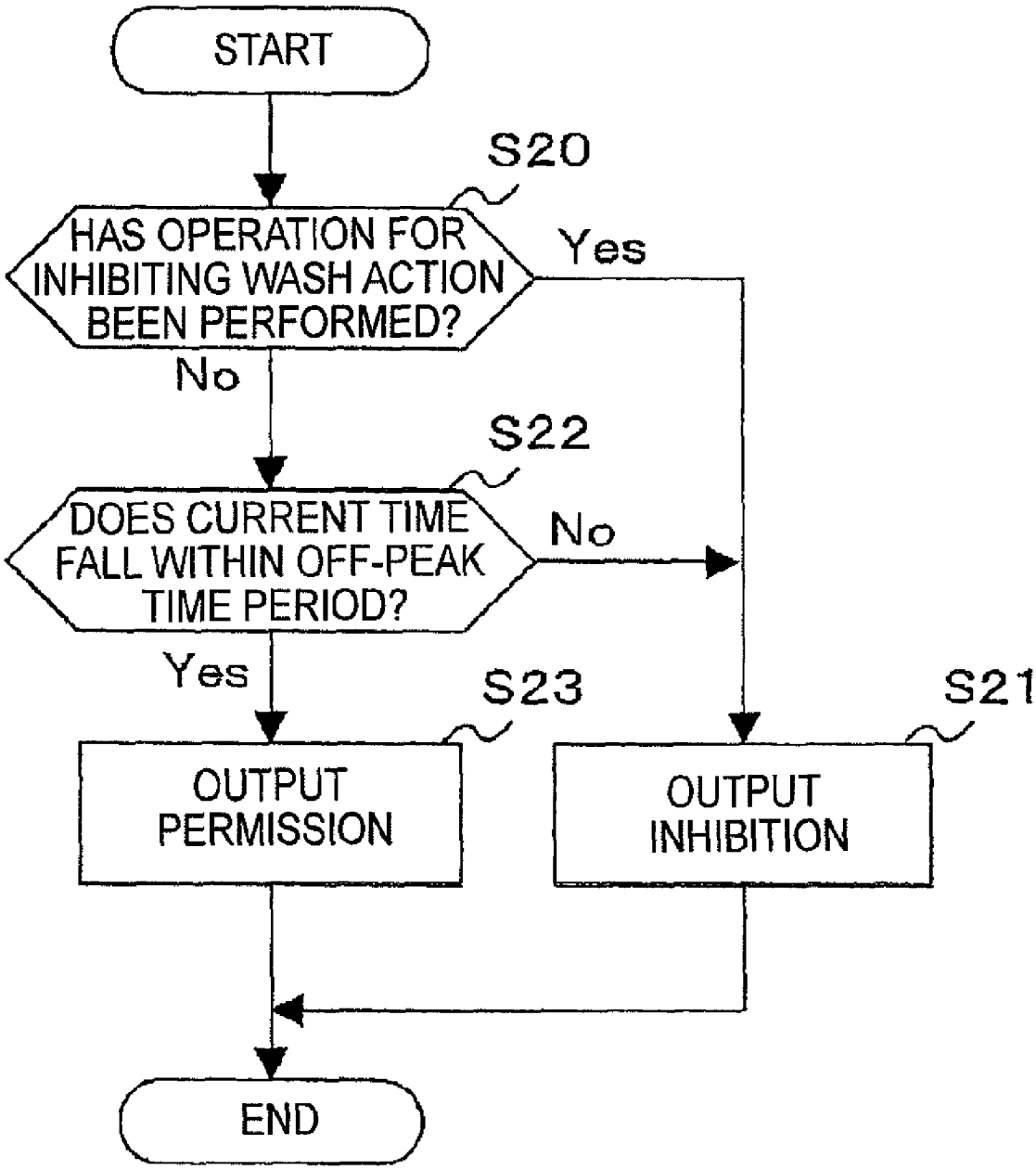
FIG. 7 is a flow chart illustrating an action of outputting a wash enabling/disabling signal, which is performed by a wash enable/disable setting section of FIG. 6.

Next, FIG. 7 is a flow chart illustrating an action of outputting the wash enabling/disabling signal, which is performed by the wash enable/disable setting section 81 of FIG. 6. In FIG. 7, after the entire ice chip dispenser is powered on, based on the enable/disable operation signal 8*a*, it is judged whether or not the user has performed an operation for inhibiting the wash action (Step S20). On this occasion, when it is judged that the operation for inhibiting the wash action has been performed, the wash enabling/disabling signal 81*a* for inhibiting the wash action from being carried out is output (Step S21). In other words, once the operation for inhibiting the wash action is performed, the wash action is always inhibited.

On the other hand, when it is judged that the operation for inhibiting the wash action has not been performed, the wash enable/disable setting section 81 judges whether or not the current time falls within the off-peak time period based on the operational information 71*a* output from the generation/delivery control section 71 (Step S22). On this occasion, when it is judged that the current time does not fall within the off-peak time period, the wash enabling/disabling signal 81*a* for inhibiting the wash action from being carried out is output (Step S21). On the other hand, when it is judged that the current time falls within the off-peak time period, the wash enabling/disabling signal 81*a* for permitting the wash action to be carried out is output (Step S23). Specifically, the wash action is inhibited during a time period when the ice-making action is more likely to be carried out, whereas the wash action is permitted only during a time period when the ice-making action is less likely to be carried out. The action of outputting the wash enabling/disabling signal is repeatedly performed while the entire ice chip dispenser is in the powered-on state.

Figure 8:
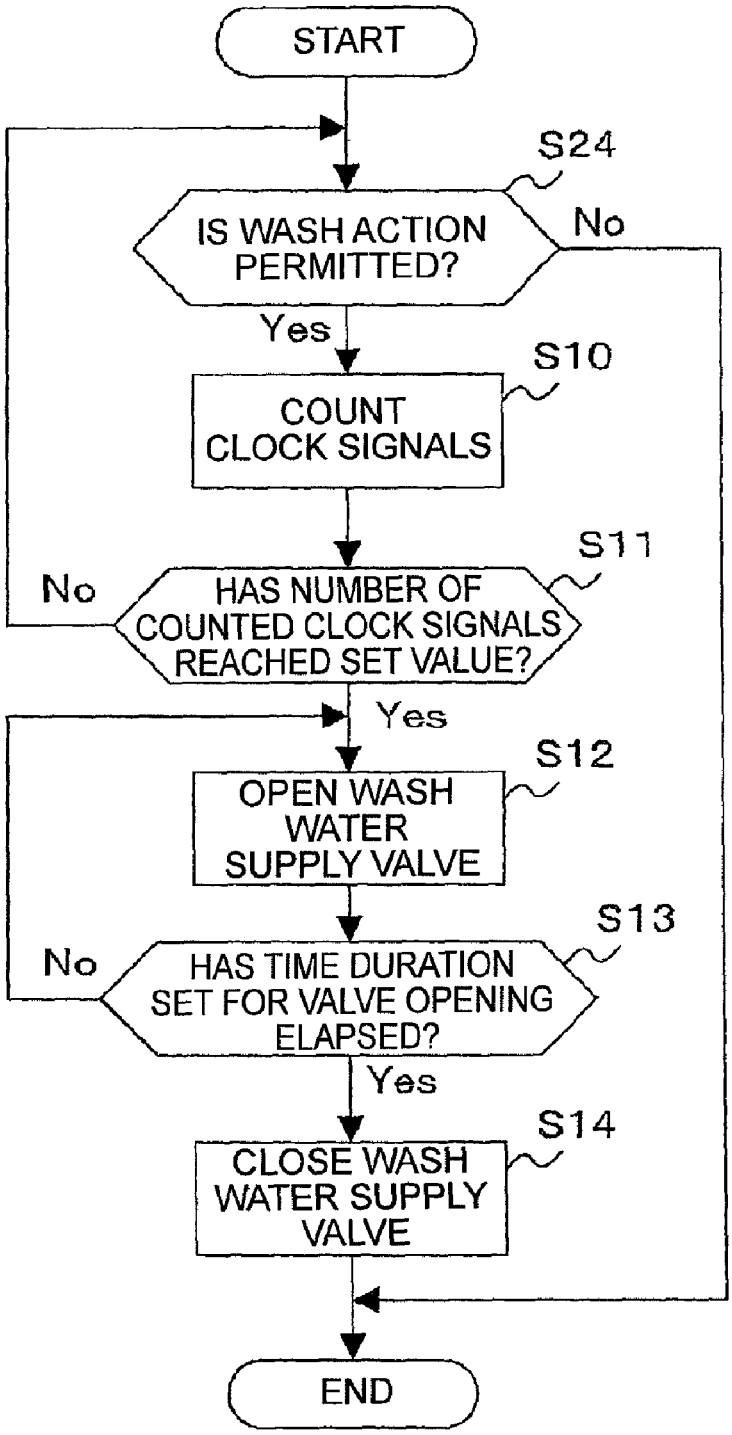
FIG. 8 is a flow chart illustrating an action of judging whether or not to carry out the wash action, which is performed by a wash control section of FIG. 6.

Next, FIG. 8 is a flow chart illustrating an action of judging whether or not to carry out the wash action, which is performed by the wash control section 82 of FIG. 6. In FIG. 8, after the entire ice chip dispenser is powered on, in response to the power-on, it is judged whether or not the wash action is permitted to be carried out based on the wash enabling/disabling signal 81*a* output from the wash enable/disable setting section 81 (Step S24). On this occasion, when it is judged that the wash action is permitted to be carried out, the clock signals are counted (Step S10), and also, it is judged whether or not the number of counted clock signals has reached the set value (Step S11). When it is judged, in this judgment, that the number of counted clock signals has not reached the set value, the wash control section 82 judges again whether or not the wash action is permitted to be carried out (Step S24). On the other hand, when it is judged that the wash action is not permitted to be carried out, the clock signals are not counted, and the action of judging whether or not to carry out the wash action is terminated. It should be noted that the action of judging whether or not to carry out the wash action is repeatedly performed while the entire ice chip dispenser is in the powered-on state. Further, the rest of the operation is the same as the action of judging whether or not to carry out the wash action, which is illustrated in FIG. 5.

In such an ice chip dispenser, the wash control section 82 determines whether or not to perform the wash action based on the wash enabling/disabling signal 81*a* output from the wash enable/disable setting section 81. Therefore, an unnecessary wash action can be inhibited, which prevents the wash water from being wasted. Specifically, the cost on the tap water used for the ice chip dispenser can be reduced, therefore resulting in reduced maintenance cost.

Further, the wash enable/disable setting section 81 judges whether or not the current time falls within the off-peak time period during which the frequency of delivering the ice chips is lower than the predetermined frequency. Then, when it is judged that the current time does not fall within the off-peak time period, the wash enable/disable setting section 81 inputs the wash enabling/disabling signal 81*a* for inhibiting the wash action from being carried out to the wash control section 82. Therefore, it is possible to prevent the wash action from affecting the ice-making action, and the ice-making action can be carried out in a more appropriate manner.

Here, in the second embodiment, there is given the description in which the wash enable/disable setting section 81 outputs the wash enabling/disabling signal 81*a* based on the enable/disable operation signal 8*a* output from the operation unit 8. However, the present invention is not limited thereto, and a wash enable/disable setting section may output a wash enabling/disabling signal based on the switching of switches or the like provided on a controller board, such as DIP switches.

Further, in the second embodiment, there is given the description in which the wash enable/disable setting section 81 judges whether or not the current time falls within the off-peak time period based on the operational information 71*a* output from the generation/delivery control section 71. However, the present invention is not limited thereto, and, by monitoring the current time, a wash enable/disable setting section may judge that the current time falls within the off-peak time period when the current time falls within a time period set in advance by the user. Further, a wash enable/disable setting section may judge that the current time falls within the off-peak time period based on a signal input from switches provided for the user to switch.

Third Embodiment

Figure 9:
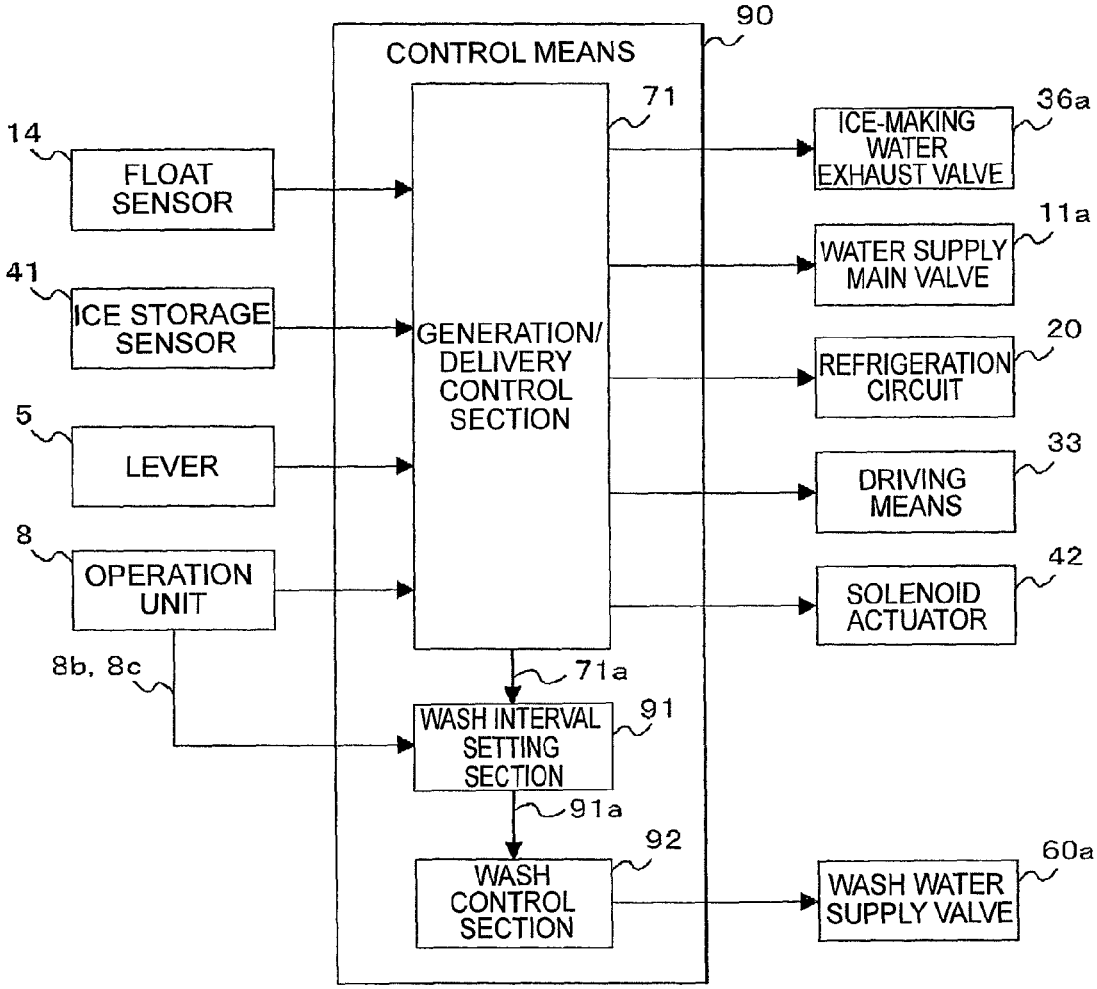
FIG. 9 is a block diagram illustrating control means of an ice chip dispenser according to a third embodiment of the present invention.

FIG. 9 is a block diagram illustrating control means 90 of an ice chip dispenser according to a third embodiment of the present invention. It should be noted that the same components as those of the first embodiment are denoted by the same reference numerals and symbols. In FIG. 9, compared to the control means 70 of the first embodiment, the control means 90 of the third embodiment is additionally provided with a wash interval setting section 91. The wash interval setting section 91 inputs a wash interval setting signal 91*a* to a wash control section 92. The wash control section 92 of the third embodiment changes a time interval for performing the wash action based on the wash interval setting signal 91*a*.

To the wash interval setting section 91, an interval changing signal 8*b* is input from the operation unit 8. The interval changing signal 8*b* is a signal that is input in response to an operation performed on the operation unit 8 by the user. The wash interval setting section 91 determines, based on the interval changing signal 8*b* output from the operation unit 8, whether to output a wash interval setting signal 91*a* for shortening the time interval for performing the wash action or to output a wash interval setting signal 91*a* for extending the time interval. Specifically, the ice chip dispenser of the third embodiment is so configured that the user can change the wash interval arbitrarily.

Specifically, the wash interval setting section 91 shortens or extends a change setting based on the input interval changing signal 8*b*. The change setting, which is information to be added to a set interval described below, is information for shortening or extending the time interval for carrying out the wash action. It should be noted that the change setting is held until predetermined reset processing is performed, such as operating a reset button, for example.

Further, to the wash interval setting section 91, a use time period setting signal 8*c* is input from the operation unit 8. The use time period setting signal 8*c* is a signal for setting a use time period during which the ice chips are delivered. Specifically, the wash interval setting section 91 is provided with a calendar function, and stores a given time period of a given day as the use time period based on the use time period setting signal 8*c*. By monitoring the current time, the wash interval setting section 91 judges whether or not the current time fails within the use time period. Further, when it is judged that the current time falls within the use time period, the wash interval setting section 91 outputs the wash interval setting signal 91*a* for shortening the time interval for performing the wash action compared to a case in which it is judged that the current time does not fall within the use time period. This configuration is made to allow the wash action to be carried out more frequently in view of the fact that more juice and the like are thrown away into the drain pan 6 during the use time period.

Specifically, the wash interval setting section 91 stores an interval for use time period and an interval for disuse time period. The interval for use time period is information for performing the wash action with a shorter interval than the interval for disuse time period. When it is judged that the current time falls within the use time period, the wash interval setting section 91 sets the interval for use time period as the set interval. When it is judged that the current time does not fall within the use time period, the wash interval setting section 91 sets the interval for disuse time period as the set interval. Further, when the wash interval setting section 91 holds the above-mentioned change setting, the wash interval setting section 91 adds the change setting to the set interval. In addition, the wash interval setting section 91 outputs, as the wash interval setting signal 91*a*, the set interval obtained after the change setting is added.

Further, to the wash interval setting section 91, the operational information 71*a* is input from the generation/delivery control section 71. Here, a time period during which the frequency of delivering the ice chips is higher than a predetermined frequency is referred to as a busy time period. The wash interval setting section 91 judges whether or not the current time falls within the busy time period based on the operational information 71*a*. When it is judged that the current time falls within the busy time period, the wash interval setting section 91 outputs the wash interval setting signal 91*a* for shortening the time interval for performing the wash action compared to a case in which it is judged that the current time does not fall within the busy time period. This configuration is made to allow the wash action to be carried out even more frequently during the busy time period.

Specifically, the wash interval setting section 91 stores an interval for busy time period. The interval for busy time period is information for performing the wash action with an even shorter interval than the above-mentioned interval for use time period. When it is judged that the current time falls within the busy time period, the wash interval setting section 91 sets the interval for busy time period as the set interval. The rest of the configuration is the same as that of the first embodiment.

Figure 10:
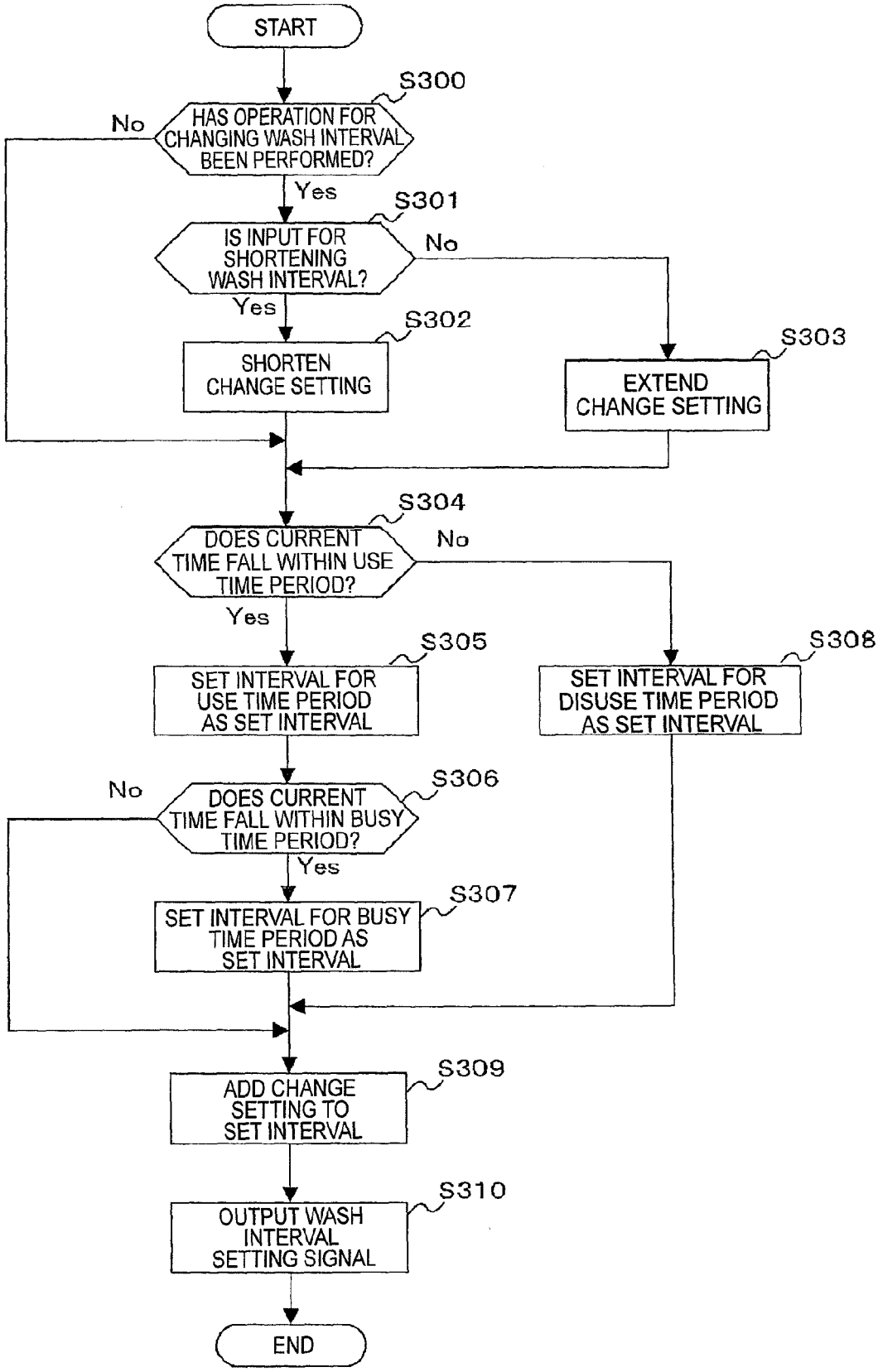
FIG. 10 is a flow chart illustrating an action of outputting a wash interval setting signal, which is performed by a wash interval setting section of FIG. 9.

Next, FIG. 10 is a flow chart illustrating an action of outputting the wash interval setting signal, which is performed by the wash interval setting section 91 of FIG. 9. In FIG. 10, after the entire ice chip dispenser is powered on, in response to the power-on, it is judged whether or not the interval changing signal 8*b* has been input from the operation unit 8, to thereby judge whether or not the user has performed an operation for changing the wash interval (Step S300). On this occasion, when it is judged that the operation for changing the wash interval has been performed, the wash interval setting section 91 judges whether or not that operation is for shortening the wash interval (Step S301). When it is judged, in this judgment, that the operation is for shortening the wash interval, the change setting is shortened (Step S302). When it is judged that the operation is not for shortening the wash interval, the change setting is extended (Step S303).

Subsequently, it is judged whether or not the current time falls within the use time period that is stored in advance (Step S304). When it is judged, in this judgment, that the current time falls within the use time period, the interval for use time period stored in advance is set as the set interval (Step S305), and, at the same time, it is judged whether or not the current time falls within the busy time period based on the operational information 71*a* (Step S306). On this occasion, when it is judged that the current time falls within the busy time period, the interval for busy time period stored in advance is set as the set interval (Step S307). When it is judged that the current time does not fall within the busy time period, the set interval is maintained to be the interval for use time period.

On the other hand, at the time of judging whether or not the current time falls within the use time period, when it is judged that the current time does not fall within the use time period, the interval for disuse time period stored in advance is set as the set interval (Step S308).

After any one of the interval for use time period, the interval for busy time period, and the interval for disuse time period is set as the set interval, the change setting is added to the set interval (Step S309), and then, the set interval obtained after the change setting is added is output as the wash interval setting signal 91*a* (Step S310). With this configuration, a set interval appropriate to a particular time period is input to the wash control section 92 after the user's operation for changing the interval is reflected onto the set interval. It should be noted that the action of outputting the wash interval setting signal is repeatedly performed while the entire ice chip dispenser is in the powered-on state. Further, when the action of outputting the wash interval setting signal is terminated, the change setting is not reset but is held as it is.

Figure 11:
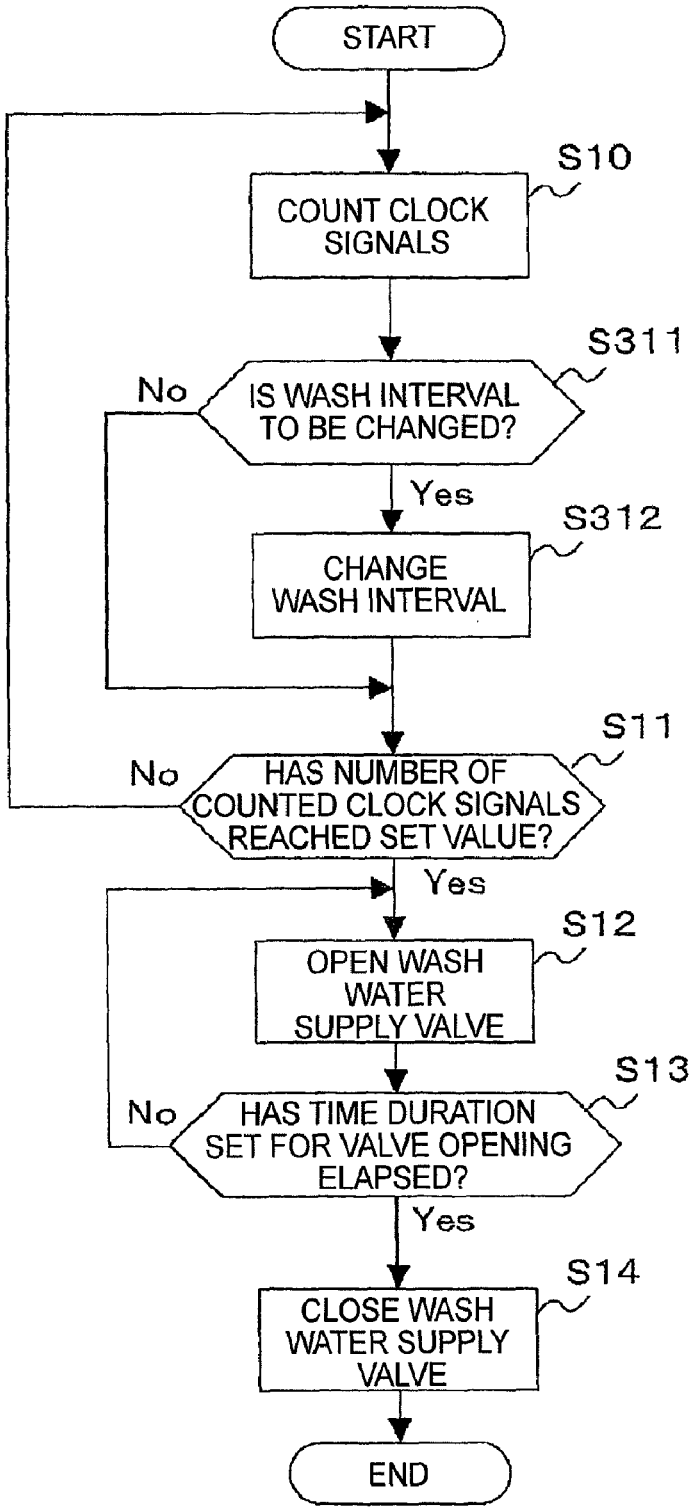
FIG. 11 is a flow chart illustrating an action of judging whether or not to carry out the wash action, which is performed by a wash control section of FIG. 9.

Next, FIG. 11 is a flow chart illustrating an action of judging whether or not to carry out the wash action, which is performed by the wash control section 92 of FIG. 9. In FIG. 11, after the entire ice chip dispenser is powered on, in response to the power-on, the clock signals are counted (Step S10), and also, it is judged whether or not the wash interval is to be changed based on the wash interval setting signal 91*a* (Step S311). On this occasion, when it is judged that the wash interval is to be changed, the wash interval is changed by changing a set value for the number of counted clock signals based on the wash interval setting signal 91*a* (Step S312). The rest of the action is the same as the action of judging whether or not to carry out the wash action, which is illustrated in FIG. 5.

In such an ice chip dispenser, the wash control section 92 changes the time interval for performing the wash action based on the wash interval setting signal 91*a*, and hence the wash action can be carried out with an interval appropriate to the installation environment. As a result, it is possible to prevent the wash water from being used unnecessarily.

Further, the wash interval setting section 91 judges whether or not the current time falls within the use time period during which the ice chips are delivered. Then, when it is judged that the current time falls within the use time period, the wash interval setting section 91 inputs, to the wash control section 92, the wash interval setting signal 91*a* for shortening the wash interval compared to the case in which it is judged that the current time does not fall within the use time period. Therefore, the wash action can be carried out with a more appropriate interval, and it is possible to more reliably prevent juice and the like from adhering to the drain pan 6 while preventing the wash water from being wasted.

Further, the wash interval setting section 91 judges whether or not the current time falls within the busy time period during which the frequency of delivering the ice chips is higher than the predetermined frequency. Then, when it is judged that the current time falls within the busy time period, the wash interval setting section 91 inputs, to the wash control section 92, the wash interval setting signal 91*a* for shortening the wash interval compared to the case in which it is judged that the current time does not fall within the busy time period. Therefore, it is possible to more reliably prevent juice and the like from adhering to the drain pan 6 even during a time period when more juice and the like are likely to be thrown away into the drain pan 6.

Here, in the third embodiment, there is given the description in which the wash interval setting section 91 stores a given time period of a given day as the use time period based on the use time period setting signal 8*c*, and, by monitoring the current time, judges whether or not the current time falls within the use time period. However, the present invention is not limited thereto, and a wash interval setting section may judge whether or not the current time falls within the use time period based on a signal that is input in response to the user's operation of the operation unit or other switches. Specifically, the ice chip dispenser may be so configured that the user can switch the settings as to whether or not the current time falls within the use time period. Based on the setting thus determined, it may be judged whether or not the current time falls within the use time period.

Further, in the third embodiment, there is given the description in which the wash interval setting section 91 judges whether or not the current time falls within the busy time period based on the operational information 71*a* output from the generation/delivery control section 71. However, by monitoring the current time, a wash interval setting section may judge that the current time falls within the busy time period when the current time falls within a time period set in advance by the user. Further, a wash interval setting section may judge that the current time falls within the busy time period based on a signal input from switches provided for the user to switch.

Fourth Embodiment

Figure 12:
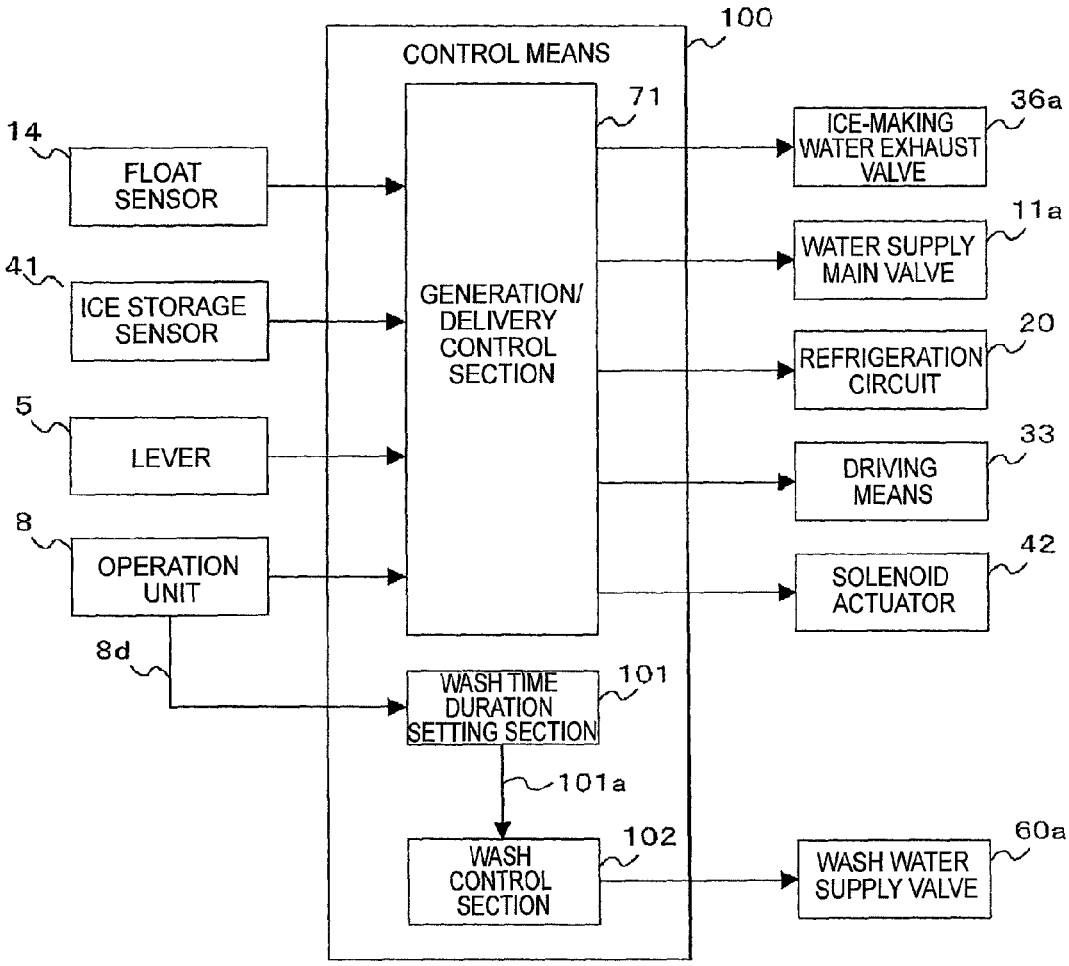
FIG. 12 is a block diagram illustrating control means of an ice chip dispenser according to a fourth embodiment of the present invention.

FIG. 12 is a block diagram illustrating control means 100 of an ice chip dispenser according to a fourth embodiment of the present invention. It should be noted that the same components as those of the first embodiment are denoted by the same reference numerals and symbols. In FIG. 12, compared to the control means 70 of the first embodiment, the control means 100 of the fourth embodiment is additionally provided with a wash time duration setting section 101. The wash time duration setting section 101 inputs a wash time duration setting signal 101*a* to a wash control section 102. At the time of performing the wash action, the wash control section 102 of the fourth embodiment changes a time duration of valve opening of the wash water supply valve 60*a* based on the wash time duration setting signal 101*a*.

To the wash time duration setting section 101, a time duration changing signal 8*d* is input from the operation unit 8. The time duration changing signal 8*d* is a signal that is input in response to an operation performed on the operation unit 8 by the user. The wash time duration setting section 101 determines, based on the time duration changing signal 8*d*, whether to output a wash time duration setting signal 101*a* for extending the time duration of valve opening or to output a wash time duration setting signal 101*a* for shortening the time duration of valve opening. Specifically, the ice chip dispenser of the fourth embodiment is so configured that the user can arbitrarily change the wash time duration, that is, a time duration during which a state of supplying the wash water to the drain pan 6 is maintained. In other words, the ice chip dispenser of the fourth embodiment is so configured that the amount of the wash water to be supplied to the drain pan 6 can be changed arbitrarily.

Figure 13:
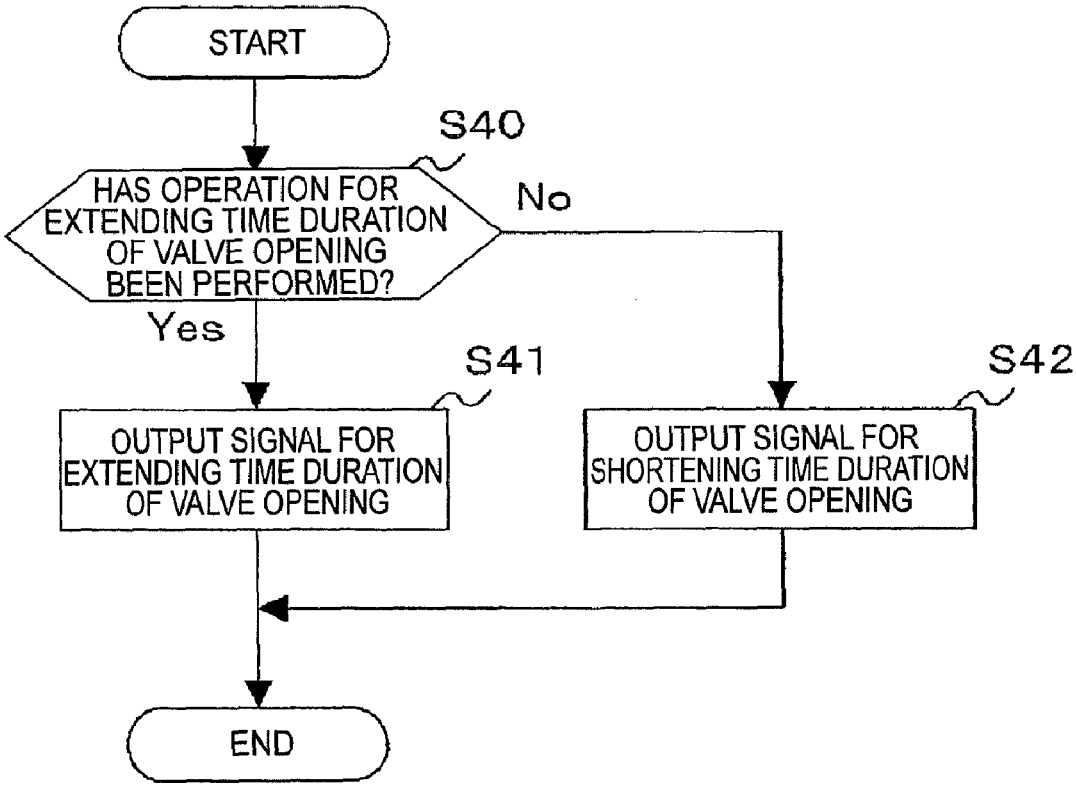
FIG. 13 is a flow chart illustrating an action of outputting a wash time duration setting signal, which is performed by a wash time duration setting section of FIG. 12.

Next, FIG. 13 is a flow chart illustrating an action of outputting the wash time duration setting signal, which is performed by the wash time duration setting section 101 of FIG. 12. In FIG. 13, when the time duration changing signal 8*d* input from the operation unit 8 is detected, the wash time duration setting section 101 judges whether or not the user has performed an operation for extending the time duration of valve opening based on the time duration changing signal 8*d* (Step S40). On this occasion, when it is judged that the operation for extending the time duration of valve opening has been performed, the wash time duration setting signal 101*a* for extending the time duration of valve opening is output (Step S41). On the other hand, when it is judged that the operation for extending the time duration of valve opening has not been performed, the wash time duration setting signal 101*a* for shortening the time duration of valve opening is output (Step S42). The action of outputting the wash time duration setting signal is repeatedly performed every time the time duration changing signal 8*d* is detected.

Figure 14:
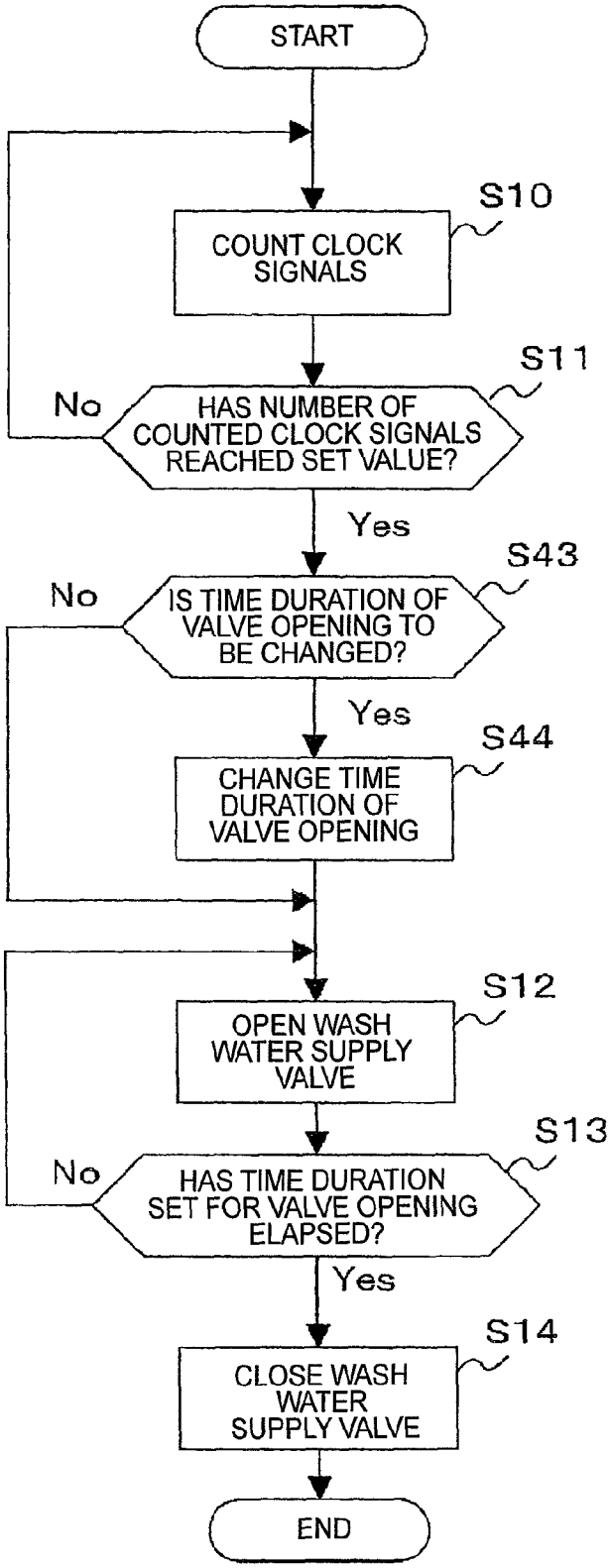
FIG. 14 is a flow chart illustrating an action of judging whether or not to carry out the wash action, which is performed by a wash control section of FIG. 12.

Next, FIG. 14 is a flow chart illustrating an action of judging whether or not to carry out the wash action, which is performed by the wash control section 102 of FIG. 12. In FIG. 14, after the entire ice chip dispenser is powered on, in response to the power-on, the counting of the clock signals is started (Step S10), and also, it is judged whether or not the number of counted clock signals has reached the set value (Step S11).

When it is judged, in this judgment, that the number of counted clock signals has reached the set value, the wash control section 102 judges whether or not the time duration of valve opening is to be changed based on whether or not the wash time duration setting signal 101*a* has been input (Step S43). On this occasion, when it is judged that the time duration of valve opening is to be changed, the time duration of valve opening is changed based on the wash time duration setting signal 101*a* (Step S44), and then, the wash action is carried out (Steps S12 to S14). On the other hand, when it is judged that the time duration of valve opening is not to be changed, the wash action is carried out without changing the time duration of valve opening. The rest of the action is the same as the action of judging whether or not to carry out the wash action, which is illustrated in FIG. 5.

In such an ice chip dispenser, at the time of performing the wash action, the wash control section 102 changes the time duration of valve opening of the wash water supply valve 60*a* based on the wash time duration setting signal 101*a*. Therefore, a wash action appropriate to the installation environment can be carried out, and it is possible to prevent the wash water from being wasted. Specifically, the cost on the tap water used for the ice chip dispenser can be reduced, therefore resulting in reduced maintenance cost.

Here, in the fourth embodiment, there is given the description in which the wash time duration setting section 101 outputs the wash time duration setting signal 101*a* based on the time duration changing signal 8*d* input from the operation unit 8. However, the present invention is not limited thereto, and a wash time duration setting section may output a time duration changing signal based on the switching of switches or the like provided on a controller board, such as DIP switches, for example.

Further, in the first to fourth embodiments, there is given the description in which the wash water is supplied to the drain pan 6 with the use of the wash water supply path 60 connecting the wash water discharge opening 7 and the external tap water system 2, and the wash water supply valve 60*a* provided to the wash water supply path 60. However, other piping and another valve may serve as the wash water supply path 60 and the wash water supply valve 60*a*, respectively.

Specifically, the following configuration may be employed. One end of the overflow drain tube 12 connected to the lower end of the overflow pipe 15 is connected to the wash water discharge opening 7. Then, by opening the water supply main valve 11*a* provided to the water supply main tube 11, an overflow is caused intentionally, to thereby supply the overflow water to the drain pan 6 as the wash water. On this occasion, the water supply main tube 11, the ice-making water tank 10, the overflow pipe 15, and the overflow drain tube 12 serve as a wash water supply path, whereas the water supply main valve 11*a* serves as a wash water supply valve.

Further, the following configuration may also be employed. One end of the ice-making water exhaust pipe 36 connected to the lower portion of the refrigeration casing 31 is connected to the wash water discharge opening 7. Then, by opening the ice-making water exhaust valve 36*a* provided to the ice-making water exhaust pipe 36, the ice-making water stored in the refrigeration casing 31 is supplied to the drain pan 6 as the wash water. On this occasion, the ice-making water exhaust pipe 36 serves as a wash water supply path, whereas the ice-making water exhaust valve 36*a* serves as a wash water supply valve.

Here, in the first to fourth embodiments, there is given the description of the configuration of the ice chip dispenser. However, the present invention is not limited thereto, and may be applied to any dispenser for delivering a supply containing at least one of a drink and ice chips from the delivery opening. Specifically, the present invention can be applied to a drink dispenser having a configuration in which only drinks are delivered, or a drink dispenser having a configuration in which ice chips are supplied together with drinks.

What is claimed is:

1. A dispenser that delivers a supply containing at least one of a drink and ice chips from a delivery opening, and that has a drain pan disposed below the delivery opening so that the supply is received, wherein the dispenser comprises:

a generation/delivery control section for controlling generation and delivery of the supply;

a wash water discharge opening provided to the drain pan;

a wash water supply path connected to the wash water discharge opening;

a wash water supply valve provided to the wash water supply path; and a wash control section connected to the wash water supply valve, for performing, by opening the wash water supply valve, a wash action of supplying wash water to the drain pan through the wash water supply path and the wash water discharge opening, and wherein the wash control section performs timing separately from control of the generation/delivery control section, and performs the wash action at predetermined time intervals.

2. A dispenser according to claim 1, wherein the dispenser further comprises a wash enable/disable setting section connected to the wash control section, for inputting a wash enabling/disabling signal to the wash control section, and wherein the wash control section determines whether or not to perform the wash action based on the wash enabling/disabling signal.

3. A dispenser according to claim 2, wherein the wash enable/disable setting section judges whether or not a current time falls within an off-peak time period during which a frequency of delivering the supply is lower than a predetermined frequency, and, when it is judged that the current time is out of the off-peak time period, inputs the wash enabling/disabling signal for inhibiting the wash action from being carried out to the wash control section.

4. A dispenser according to claim 1, wherein the dispenser further comprises a wash interval setting section connected to the wash control section, for inputting a wash interval setting signal to the wash control section, and wherein the wash control section changes a time interval for performing the wash action based on the wash interval setting signal.

5. A dispenser according to claim 4, wherein the wash interval setting section judges whether or not the current time falls within a use time period during which the supply is delivered, and, when it is judged that the current time falls within the use time period, inputs, to the wash control section, the wash interval setting signal for shortening the time interval for performing the wash action compared to a case in which it is judged that the current time is out of the use time period.

6. A dispenser according to claim 4, wherein the wash interval setting section judges whether or not the current time falls within a busy time period during which the frequency of delivering the supply is higher than the predetermined frequency, and, when it is judged that the current time falls within the busy time period, inputs, to the wash control section, the wash interval setting signal for shortening the time interval for performing the wash action compared to a case in which it is judged that the current time is out of the busy time period.

7. A dispenser according to claim 1, wherein the dispenser further comprises a wash time duration setting section connected to the wash control section, for inputting a wash time duration setting signal to the wash control section, and wherein, at a time of performing the wash action, the wash control section changes a time duration of valve opening of the wash water supply valve based on the wash time duration setting signal.

* * * * *